US005806665A

United States Patent [19]

Houssian

[11] Patent Number: 5,806,665

[45] Date of Patent: Sep. 15, 1998

[54] ARCUATE SWITCH ACTUATOR

[75] Inventor: Vazgen Houssian, Union City, N.J.

[73] Assignee: American Tack & Hardware Co., Inc., Monsey, N.Y.

[21] Appl. No.: 914,004

[22] Filed: Aug. 6, 1997

[51] Int. Cl.[6] ..... H01H 3/20

[52] U.S. Cl. ..... 200/330; 200/333; 200/339

[58] Field of Search ..... 200/330, 339, 200/331, 333, 329, 372.1

[56] References Cited

U.S. PATENT DOCUMENTS

| | | | |
|---|---|---|---|
| D. 254,849 | 4/1980 | Matsuda | D13/38 |
| D. 256,011 | 7/1980 | Matsuda | D13/38 |
| D. 307,743 | 5/1990 | Pierce et al. | D13/170 |
| D. 309,290 | 7/1990 | Newmark et al. | D13/169 |
| D. 311,371 | 10/1990 | Jacoby | D13/171 |
| D. 314,556 | 2/1991 | Aggson | D13/173 |
| D. 316,250 | 4/1991 | Mongeau | D13/170 |
| D. 324,816 | 3/1992 | LeDuc | D8/353 |
| D. 331,742 | 12/1992 | Fujiyoshi | D13/169 |
| D. 331,743 | 12/1992 | Fujiyoshi | D13/169 |
| D. 333,124 | 2/1993 | Carson | D13/169 |
| D. 335,867 | 5/1993 | Bowen | D13/171 |
| D. 336,744 | 6/1993 | Kahn et al. | D13/171 |
| D. 341,568 | 11/1993 | Sorenson et al. | D13/174 |
| D. 345,344 | 3/1994 | Schaeffer | D13/171 |
| D. 347,211 | 5/1994 | Dickens | D13/171 |
| D. 351,376 | 10/1994 | Hughes | D13/177 |
| D. 360,876 | 8/1995 | Hughes | D13/177 |
| 3,121,778 | 2/1964 | Sander et al. | 220/331 |
| 4,164,635 | 8/1979 | Finch et al. | 200/33 |
| 4,234,774 | 11/1980 | Paparella | 200/330 |
| 4,242,552 | 12/1980 | Tibolla | 200/339 |
| 4,348,564 | 9/1982 | Ohtaki et al. | 200/67 |
| 4,352,967 | 10/1982 | Buchtel | 200/153 |
| 4,427,864 | 1/1984 | Oster | 200/330 |
| 4,454,401 | 6/1984 | Powis, Jr. | 200/331 |
| 4,488,024 | 12/1984 | Colgate | 200/300 |
| 4,508,943 | 4/1985 | Preiffer et al. | 200/17 |
| 4,524,250 | 6/1985 | Laviana | 200/33 |
| 4,563,553 | 1/1986 | Wilson et al. | 200/17 |
| 4,631,354 | 12/1986 | Boteler | 174/66 |
| 4,672,229 | 6/1987 | Skarman et al. | 307/115 |
| 4,757,168 | 7/1988 | Fujiyoshi et al. | 200/296 |
| 4,760,227 | 7/1988 | Boxer | 200/330 |
| 4,872,099 | 10/1989 | Kelly et al. | 200/330 |
| 4,880,950 | 11/1989 | Carson et al. | 200/547 |
| 4,914,265 | 4/1990 | Mongeau | 200/330 |
| 4,972,045 | 11/1990 | Primeau | 174/66 |
| 5,134,258 | 7/1992 | Carrodus | 200/330 |
| 5,180,886 | 1/1993 | Dierenbach et al. | 174/66 |
| 5,212,347 | 5/1993 | Powers et al. | 174/67 |
| 5,306,957 | 4/1994 | Ellingham et al. | 307/141 |
| 5,393,946 | 2/1995 | DeLaHoz | 200/331 |
| 5,500,496 | 3/1996 | Venzke et al. | 200/302.3 |
| 5,577,602 | 11/1996 | Conner et al. | 200/331 |
| 5,590,759 | 1/1997 | Hawkins et al. | 200/331 |
| 5,595,289 | 1/1997 | Kurek et al. | 200/559 |

*Primary Examiner*—David J. Walczak
*Attorney, Agent, or Firm*—Hedman, Gibson Costigan, P.C.

[57] ABSTRACT

An arcuate switch plate assembly for a standard wall toggle switch comprising a convex base plate and a convex switch actuator wherein the convex actuator moves in an arc similar to the arc of the toggle switch.

11 Claims, 3 Drawing Sheets

ARCUATE SWITCH ACTUATOR

FIELD OF THE INVENTION

This invention relates an arcuate switch actuator intended for use in combination with a standard wall toggle switch. The arcuate switch actuator comprises a convex base and a corresponding convex actuator which allows the convex actuator to move in an arc motion similar to the arc of the toggle switch, thereby creating a more fluid movement of the actuator than provided by conventional actuators.

BACKGROUND OF THE INVENTION

Standard wall toggle switches can be found in just about every home and office and have been used for many years to control the flow of electric current to such items as outlets and lighting fixtures. A number of switch covers and/or switch extending apparatus have been developed over the lifetime of the standard wall toggle switch. U.S. Pat. Nos. 5,577,602, 5,306,957, 4,972,045, 4,914,265, 4,760,227 and 4,427,864 provide a sampling of the various switch plate covers that have been developed in the past. In these prior switch plate covers, the actuators move only in a linear manner while the toggle switch moves in semicircular or an arc motion. The interaction of the linear and arc motions result in a rough or non-fluid movement.

SUMMARY OF THE INVENTION

It is an objective of the present invention to provide a switch actuator for a standard wall toggle switch that provides a smooth or fluid interaction between the toggle switch and the actuator.

It is a further object of the invention to provide a switch actuator that can be attached to a standard wall toggle switch without the need for electrical connections or assembly of parts by the consumer.

It is a further object of the present invention to provide a switch actuator with a simple and uncluttered appearance.

The foregoing objectives are met by an arcuate switch actuator comprising a convex base and a corresponding convex actuator. The convex base comprises an outer convex surface, an inner concave surface, a means for attaching the switch actuator to a standard wall toggle switch.

The convex actuator comprises a means for slidably attaching the convex actuator to the convex base plate and a means for moving a toggle arm of a standard wall toggle switch from the off to the on position and vice versa. To move the toggle arm from one position to the other, the convex actuator is moved along the convex shape of the base plate in an arcing motion that is similar to the arc that is defined by the movement of the toggle arm.

The present invention can be made from any type of material commonly used in the industry to manufacture switch plates and outlet covers. It is preferred that the present invention be made from a plastic material such as polycarbonate, polyethylene, polypropylene, nylon or polystyrene, although wood or aluminum may also be used.

DETAILED DESCRIPTION OF THE INVENTION

Figure 1:
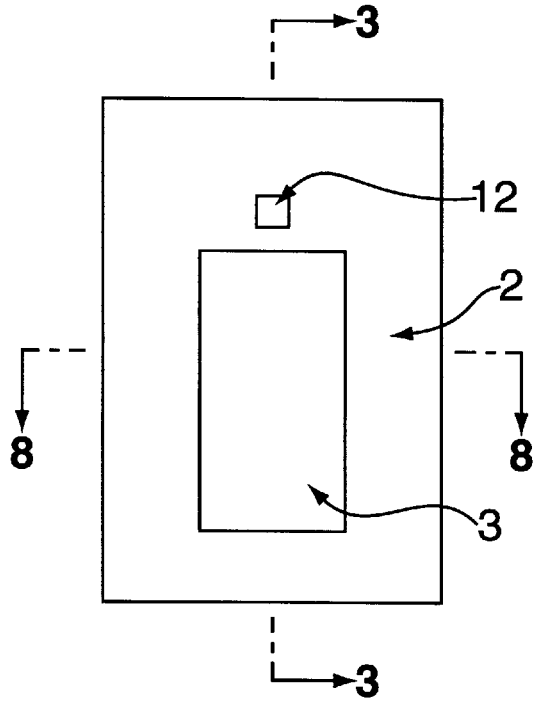
FIG. 1 is a front view of a preferred embodiment of the present invention.
Figure 2:
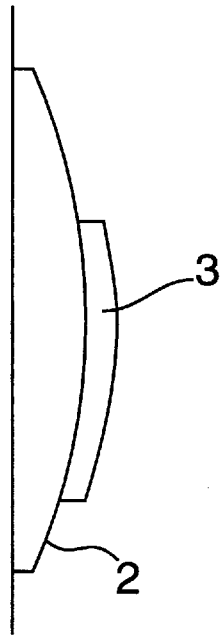
FIG. 2 is a side view of a preferred embodiment of the present invention.
Figure 3:
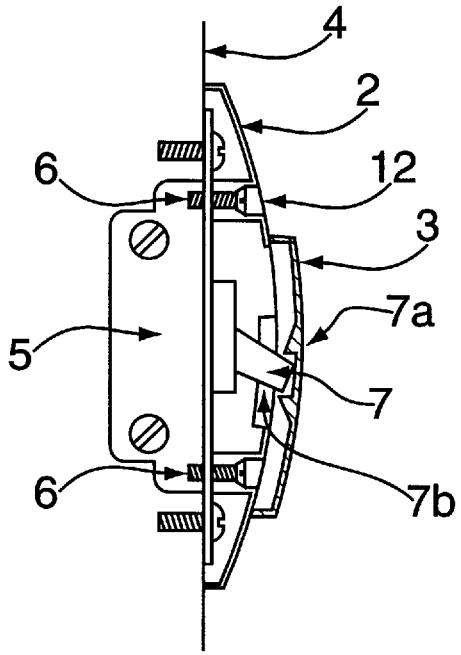
FIG. 3 is a side sectional view of a preferred embodiment of the present invention taken along lines 3—3 of FIG. 1 when it is attached to a standard wall toggle switch.

The present invention will be described in detail by reference to the drawings. The drawings are for illustration and are not intended to limit the scope of the invention.

Referring to FIGS. 1, 2, 3 and 6, the present invention is an arcuate switch actuator 1 comprising a convex base plate 2 and a convex actuator 3. The convex base plate 2 is attached to a standard wall toggle switch 5 in conventional manner using two screws 6. As clearly shown in FIGS. 3 and 6, it is preferred that the screws 6 be recessed into the convex base plate 2 so they do not interfere with the movement of the convex actuator 3. In a preferred embodiment, the base of the convex base plate 2 has a length of approximately 4.625 inches and a width of approximately 2.828 inches. The arc of the outer surface 200 of the convex base plate 2 could have a radius of approximately 3.00 to 8.00 inches, preferably 6.50 to 7.50 inches and most preferably approximately 7.25 inches. The convex base plate 2 has a uniform wall thickness of approximately 0.050 to 0.100 inches thick.

Figure 4:
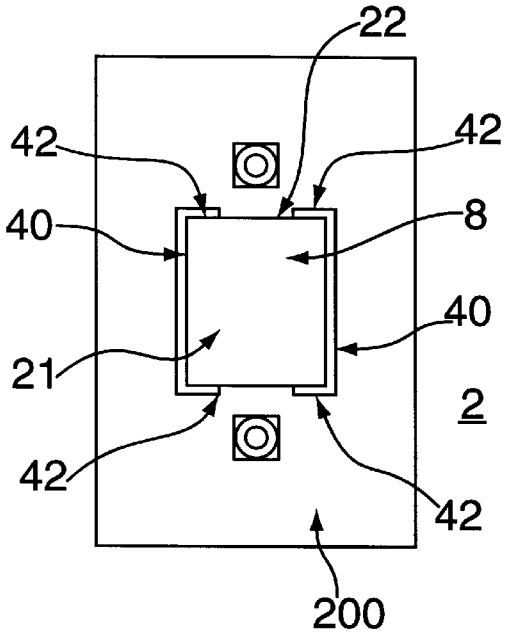
FIG. 4 is a front view of a preferred embodiment of the convex base plate of the present invention as shown in FIG. 1.
Figure 5:
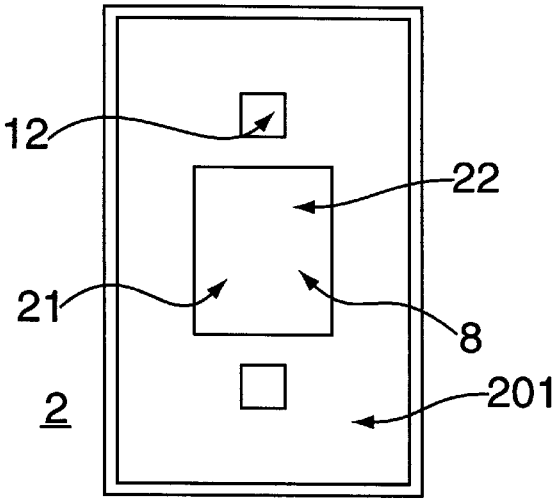
FIG. 5 is a rear view of a preferred embodiment of the convex base plate of the present invention as shown in FIG. 1.
Figure 6:
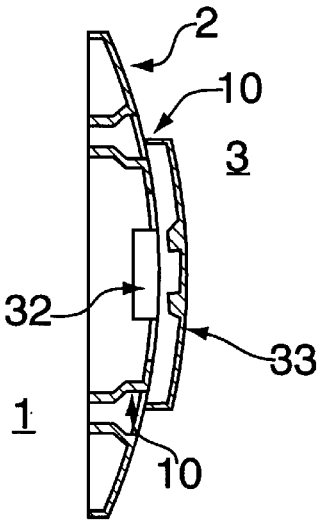
FIG. 6 is a side sectional view of a preferred embodiment of the present invention taken along lines 3—3 of FIG. 1 when it is not attached to a standard wall toggle switch.

In another preferred embodiment of the present invention, the top of the attaching screws 6 are covered with plugs 12. The plugs 12 can be any shape such as circular, triangular or square as shown in FIGS. 1 and 4. The plugs 12 may be made from the same or different material used to manufacture the convex base plate 2. It is preferred that the two plugs 12 be different colors to indicate whether the toggle switch 5 is in the off or the on position.

A toggle convex aperture 8 is formed in the convex base plate 2. The toggle convex aperture 8 is sized and positioned to expose the toggle arm 7 of the standard wall toggle switch 5 and allow the actuator projections 33 to contact the toggle arm 7 when the arcuate switch actuator assembly is engaged to the toggle switch 5. The toggle convex aperture 8 must be large enough to allow the toggle arm 7 to move unencumbered from the on position to the off position and vise versa. In the preferred embodiment, the convex toggle aperture 8 is convexly rectangular in shape wherein the longitudinal convex edges 21 are a uniform wall thickness of approximately 0.050 to 0.100 inches thick.

Figure 8:
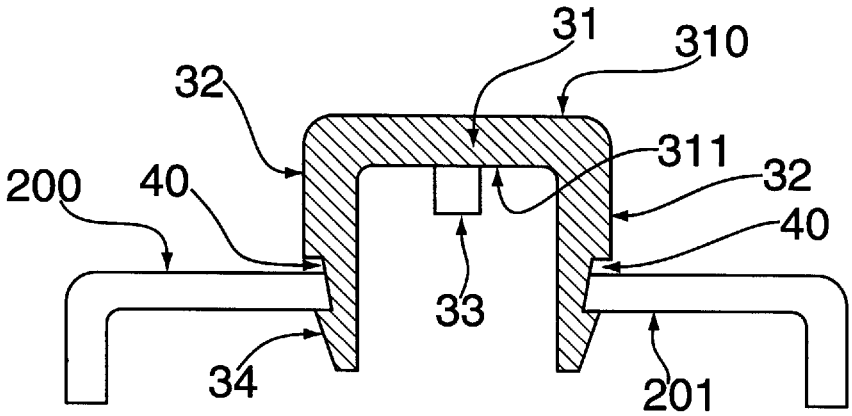
FIG. 8 is a partial bottom sectional view of a preferred embodiment of the present invention taken along lines 8—8 of FIG. 1.
Figure 9:
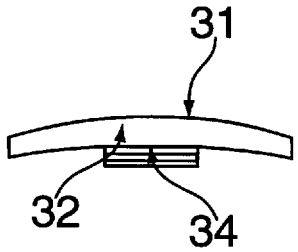
FIG. 9 is a side view of a preferred embodiment of the convex actuator of the present invention.

As shown in FIG. 8, the longitudinal convex edges 21 are angled inwardly from the outer surface 200 of the convex base plate 2 to the inner concave surface 201 of the convex base plate 2. The preferred angle is approximately 10° to 20° and most preferably approximately 15°.

The convex switch actuator 3 comprises a convex top surface 31 and two walls 32 which depend downwardly from the top convex surface 31. The top surface further comprises an convex outer face 310 and a concave inner face 311. Depending downwardly from the inner face 311 is a means for moving the toggle arm 7. In a preferred embodiment the means comprise protrusions 33 which contact the top 7*a* and bottom 7*b* surfaces of the toggle arm 7. The protrusions 33 cause the toggle arm 7 to move from the on position to the off position and vise versa as the convex actuator 3 is moved in an arc motion with respect to the convex base plate 2.

Figure 7:
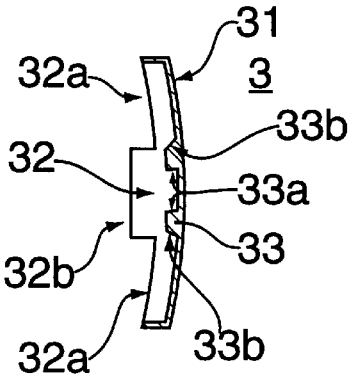
FIG. 7 is a side sectional view of a preferred embodiment of the convex actuator of the present invention taken along lines 3—3 of FIG. 1.

The exact dimensions of the convex actuator 3 is not critical to the invention as long as it moves in an arc that corresponds to the convex arc of the base plate 2. As shown in FIG. 7, the distance between the inner surfaces 33*a* of protrusions 33 is greater than the width of the largest toggle arm switch manufactured by various switch manufactures. The bottom 32*a* of the actuator walls 32 has a radius that corresponds to the radius of the convex base plate 2.

The convex actuator 3 is slidably engaged in an arc motion onto the convex base plate 2. In the preferred embodiment, the means for slidably engaging at the factory the convex actuator 3 to the base plate 2 comprise a arc groove 34 on the convex actuator wall 32 which interacts with the longitudinal convex edges 21 of the toggle aperture 8 on the convex face plate 2. The arc groove 34 is slightly larger than the wall thickness of the convex base plate 2. As shown in FIG. 8, the actuator walls 32 and arc grooves 34 are angled to correspond to the angle on the longitudinal convex edges 21 of the toggle aperture 8. These angles allow the convex actuator 3 to be engaged to the convex base plate 2 with a reduced amount of effort.

Depending upon the type of material used to manufacture the arcuate switch actuator assembly 1, the convex actuator 3 may have a tendency over time to mar or scratch the outer surface 200 of the convex base plate 2. To prevent the marring of the convex base plate 2, with the convex actuator the convex base plate 2 may optionally comprise a means for preventing marring. In a preferred embodiment, the means to prevent marring are small rib projections or ribs 40 which extend upwardly from the outer surface 200 of the convex base plate 2. These rib projections 40 are preferably located close to the right and left edges of the toggle convex aperture 8 and the outer lateral distance between the two rib projections 40 is slightly less then the lateral distance of the top surface 31 of the convex actuator 3. The rib projections 40 prevent the convex actuator 3 from contacting the outer surface 200 of the convex base plate 2.

As shown in FIG. 4, the present inventions may optionally comprise small bosses 42 which provide added stability to the movement of the convex actuator 3. The bosses 42 are preferably located on the convex base plate 2 at a distance that corresponds to the dimension of the inner portions of the depending walls 32 of the convex actuator 3. It is preferred that the bosses 42 be sized so that they provide the required stability but are not visible when the convex actuator 3 is engaged by the convex base plate 2.

Once the arcuate switch actuator assembly 1 is mounted on the standard wall toggle switch 5, the standard wall toggle switch 5 is operated by sliding in an arc motion, the convex actuator 3 to the up position or the down position, which in turn will traverse the toggle arm 7 to pivot to the up position and the down position respectively. If the standard toggle switch 5 is connected to the electric circuitry according to the established convention, the up position for the toggle arm 7 and the convex actuator 3 will correspond to the on position and the down position for the toggle arm 7 and convex actuator 3 will correspond to the off position. Due to the complementary convex shape of the base plate 2 and the convex actuator 3, which approximates the arc of the toggle arm 7, the movement of the convex actuator 3 from the off and on positions can be accomplished in a smooth and fluid type of movement.

In a preferred embodiment of the present invention, the convex actuator 3 is sized so that only one attaching screw 6 or plug 12 is visible when the convex actuator is in the off or on position. More specifically, when the convex actuator 3 is in the off position only the upper attaching screw 6 or plug 12 is visible because the convex actuator 3 is covering the lower attaching screw 6 or plug 12. Similarly when the convex actuator 3 is in the up or on position only the lower attaching screw 6 or plug 12 is visible because the convex actuator 3 is covering the upper attaching screw 6 or plug 12. By making the upper and lower attaching screws and/or plugs different colors, the user of the present invention can quickly determine whether the toggle arm 7 is in the on or off position by a quick inspection of the location and/or color of the visible attaching screw 6 or plug 12.

Many variations of the present invention will suggest themselves to those skilled in this art in light of the above, detailed description. For example, the sizes of the convex base plate 2 and convex actuator 3 may be varied. The shape of the base convex plate 2 and convex actuator 3 can be varied from a convex rectangular shape to an convex oval, circle or other ornamental shape. In addition, the invention can be used on double or multiple wall switch arrangements. All such obvious modifications are within the full intended scope of the appended claims.

All the above mentioned patents, publications and test methods are herein incorporated by reference.

I claim:

1. An arcuate switch actuator assembly consisting essentially of:

(a) a convex base plate with a toggle arm convex aperture comprising a convex outer surface, an inner concave surface, and a means for attaching the convex switch actuator assembly to a standard wall toggle switch; and (b) a convex switch actuator comprising: a convex outer surface, a means for slidably attaching the convex actuator to an outer surface of the convex base plate and a means for pivoting a toggle arm of a standard wall toggle switch from a first position to a second position by sliding the convex switch actuator in an arc motion.

2. An arcuate switch actuator assembly as defined in claim 1 wherein the means for attaching the convex base plate to a standard wall toggle switch comprises two screws which pass through apertures in the convex base plate and adapted to be threaded into conventionally threaded holes of the toggle switch and the toggle arm convex aperture is sized to allow a toggle arm of the toggle switch to move to move from a first position to a second position.

3. An arcuate switch actuator assembly as defined in claim 2 wherein the attaching screws are recessed into the outer surface of the convex base plate.

4. An arcuate switch actuator assembly as defined in claim 3 wherein the recessed attaching screws are concealed with a plug.

5. An arcuate switch actuator assembly as defined in claim 4 wherein the plug is a different color from the base plate.

6. An arcuate switch actuator assembly consisting essentially of:

(a) a convex base plate with a toggle arm convex aperture comprising a convex outer surface, an inner concave surface, and a means for attaching the convex switch actuator assembly to a standard wall toggle switch; and (b) a convex switch actuator comprising: a top surface with a convex outer face and a concave inner face; a means for slidably attaching the convex actuator to the convex base plate; a means for pivoting a toggle arm of a standard wall toggle switch from a first position to a second position by sliding the convex switch actuator in an arc motion and at least two walls that depend downwardly from the top surface.

7. An arcuate switch assembly actuator as defined in claim 6 wherein the two depending walls each comprise: an outer surface with a arc groove corresponding to the top surface of the convex base plate.

8. An arcuate switch actuator assembly as defined in claim 7 wherein the toggle aperture is convexly rectangular with two longitudinal edges that are curved and parallel to a pivoting movement of a toggle arm of the standard wall toggle switch.

9. An arcuate switch actuator assembly as defined in claim 8 wherein the means for slidably attaching the convex actuator to the convex base plate comprise the arc grooves on the outer surfaces of the convex actuator walls and said longitudinal edges of the toggle aperture.

10. An arcuate switch actuator assembly as defined in claim 6 wherein the means for moving the toggle arm comprise a plurality of protrusions that extend downwardly from the inner concave face of the convex actuator.

11. An arcuate switch actuator assembly as defined in claim 1 further comprising a means for preventing marring of the convex base plate by the convex actuator.

* * * * *